US011491384B2

(12) United States Patent
Berghiller

(10) Patent No.: US 11,491,384 B2
(45) Date of Patent: Nov. 8, 2022

(54) DEVICE AND METHOD FOR PROVIDING A WATER SPORTS TRACK

(71) Applicant: Rodics Innovation AB, Mullsjö (SE)

(72) Inventor: Erik Berghiller, Mullsjö (SE)

(73) Assignee: Rodics Innovation AB, Mullsjö (SE)

( * ) Notice: Subject to any disclaimer, the term of this patent is extended or adjusted under 35 U.S.C. 154(b) by 193 days.

(21) Appl. No.: 16/768,581

(22) PCT Filed: Dec. 11, 2017

(86) PCT No.: PCT/EP2017/082120
§ 371 (c)(1),
(2) Date: May 29, 2020

(87) PCT Pub. No.: WO2019/114917
PCT Pub. Date: Jun. 20, 2019

(65) Prior Publication Data

US 2021/0170260 A1 Jun. 10, 2021

(51) Int. Cl.

| | |
|---|---|
| ***A63B 69/18*** | (2006.01) |
| ***A63C 19/02*** | (2006.01) |
| ***A63C 19/06*** | (2006.01) |
| ***B63B 22/16*** | (2006.01) |
| ***B63B 32/30*** | (2020.01) |

(52) U.S. Cl.
CPC ..... *A63B 69/187* (2013.01); *A63C 19/02* (2013.01); *A63C 19/062* (2013.01); *A63C 19/065* (2013.01); *B63B 22/16* (2013.01); *A63C 2019/067* (2013.01); *B63B 32/30* (2020.02)

(58) Field of Classification Search
CPC ..... A63B 69/187; A63C 19/02; A63C 19/062; A63C 19/065; A63C 2019/067; B63B 22/16; B63B 32/30
See application file for complete search history.

(56) References Cited

U.S. PATENT DOCUMENTS

| | | | | |
|---|---|---|---|---|
| 3,135,952 | A | 6/1964 | Bretherton | |
| 5,265,583 | A * | 11/1993 | Otto | A63B 69/40 124/84 |
| 6,123,593 | A * | 9/2000 | Mercer | B63B 22/18 441/6 |
| 6,807,959 | B1 | 10/2004 | Murdock et al. | |
| 2005/0016515 | A1* | 1/2005 | Arnaud | F41A 23/38 124/56 |
| 2005/0199640 | A1* | 9/2005 | Clark | E01F 9/688 221/199 |
| 2009/0199834 | A1* | 8/2009 | Skilling | F41B 11/721 124/71 |

(Continued)

OTHER PUBLICATIONS

International Search Report for International Application No. PCT/EP2017/082120, dated Aug. 8, 2018 (3 pages).

*Primary Examiner* — Mohamed Barakat
(74) *Attorney, Agent, or Firm* — Kagan Binder, PLLC

(57) ABSTRACT

Provided is a water track marker (1) for marking a sports track, such as a water ski track, on a water surface (20). The water track marker comprises at least a first marker ejector (11) configured to eject marker projectiles (2) towards the water for creating an instant marking (3) on the water surface (20) upon impact with the water surface (20). Provided is also a method for marking a sports track and a towing boat comprising said water track marker.

21 Claims, 6 Drawing Sheets

(56) References Cited

U.S. PATENT DOCUMENTS

| | | | | |
|---|---|---|---|---|
| 2009/0255434 | A1* | 10/2009 | Pawloski | A01M 29/12<br>102/502 |
| 2010/0087110 | A1* | 4/2010 | Berg | A63C 19/00<br>441/6 |
| 2011/0136399 | A1* | 6/2011 | Mandrik | B63B 22/00<br>441/16 |

* cited by examiner

DEVICE AND METHOD FOR PROVIDING A WATER SPORTS TRACK

CROSS-REFERENCE TO RELATED APPLICATIONS

This application claims priority to International Application No. PCT/EP2017/082120, filed Dec. 11, 2017 and titled "DEVICE AND METHOD FOR PROVIDING A WATER SPORTS TRACK," which is incorporated herein by reference in its entirety.

TECHNICAL FIELD

The present disclosure relates to a course marker, and especially to an arrangement and a method related to the marking of a course in water sports.

BACKGROUND

In water sports, the marking of a course has for a long time conventionally been done by marking by buoys. Especially in water sports like water skiing, the course is commonly marked using a metal wire anchored in the sea bottom at each end, and stretched to extend horizontally along the sea bottom. The wire connects a number of branches, that lead out to the sides to which buoys are anchored and thus form a zig-zag path for the water skier to follow at the surface. Another solution can be to anchor each buoy individually in the sea bottom. These solutions provide fixed courses, which prevents a flexible course in case of weather and wind. Further, since the course is fixed, the length and extension of the course cannot be varied. Subsequently, after one finished "lap", the boat must make a large turn far from the course in order to enter the course again, so that surge from the boat turning does not affect the surface in the track. This is time and fuel consuming.

Since the wires and buoys may be kept in the water permanently, they may need frequent maintenance. Also, permanent installations may be a problem for surrounding water traffic and the water environment, which leads to difficulties in getting permission to install them altogether.

There is thus a need to find a more flexible solution to provide for a water sports course.

SUMMARY

It is an object of the present invention to provide an improved solution that alleviates the mentioned drawbacks with present devices. Furthermore, it is an object to provide a device and method to obtain an instant and temporary sports track on a water surface. The inventor has realized that this may be achieved by a device, a water track marker, ejecting a projectile, i.e. an object like e.g. a spherical ball like object to form a splash marking on a water surface. It is understood that a projectile of the kind can be any shape suitable. This splash mark may serve as a temporary marking for a sports track, and allow a performer such as a sportsman or a person that follows the track, to visually see and follow the temporary track. The water track marker may be usable in any event a temporary track need to be marked, and especially in the event of water ski events.

More particularly, according to a first aspect of the invention, there is provided a water track marker for marking a sports track, such as a water ski track, on a water surface. The water track marker comprises at least a first marker ejector configured to eject marker projectiles towards the water for creating instant markings on the water surface upon impact with the water surface. This is an advantage because it provides for a flexible track which can be used anywhere. A common drawback with present solutions is that the sports tracks normally are placed on a fixed position, which means that the trach cannot be moved to the optimal position in a lake at the specific time, e.g. based on weather conditions, such as wind or if there for some other reason would be inappropriate to exercise the water sport at that particular place one day. With a flexible, instant and temporary water track, the track can be placed anywhere suitable at that time. Further, since fixed water tracks commonly are anchored to the sea bottom, they are not suitable at some lakes due to sensitive sea bottoms or other environmental reasons. Therefore, a temporary sports track which only creates markings on the water surface does not affect the sea bottom negatively. The sports man follows the instant track directly before the markings have disappeared.

According to an embodiment, the marker ejector may be configured to be arranged on a towing boat. The towing boat may be configured to tow a person, such as a water skier for running said sports track. This allows the sports track to be arranged just before the sports person is about to use the track. Thus, the marker ejector ejects a projectile that creates a splash marking. The splash marking lingers on the surface long enough for the sports person to see and follow the marking. In water skiing, the marking may correspond to a buoy which is rounded. The marker ejector then ejects a second marker projectile to the other side, and the sport person have time to see and steer towards the second marking.

According to an embodiment, the water track marker further comprises a control system for controlling ejecting timing, for the marker ejector to eject said marker projectiles. This is an advantage since the control unit may enable the marker projectiles to be ejected in the exact right time in order for the projectiles to impact the water surface and subsequently form a marking in a predetermined way. Thus, markings may form a pattern according to predetermined regimen, such as distance between markings.

According to an embodiment, the control system may comprise a speed sensor. The control system may be adapted to controlling the ejection of said marker projectiles based on a detected speed. Since the place impact of the marker of the projectiles to the surface is dependent on when the marker projectile is ejected, it is a great advantage to monitor the speed of the towing boat. The speed of the towing boat may thus be detected and subsequently the timing between ejections of the projectiles may be controlled. In that way the sports track may be formed in a predetermined way.

In one embodiment, the speed sensor may be a global positioning system (GPS) sensor. In other embodiments, the speed sensor may be coupled to the towing boat's speed sensor.

According to an embodiment, the control system may be configured to only eject marker projectiles when the boat is travelling in a predetermined speed range, preferably when the sportsperson being towed is on his/her feet. The speed range may thus be between 40 kilometers per hour and 60 kilometers per hour. Slower or faster is possible as long as it is a comfortable speed to be towed at. By limiting the ability to eject marker projectiles, it may be secured that a projectile only is ejected when needed. A towing boat driving at low speed may mean that it is close to the shore, and also that the person being towed is not ready. Ejecting a projectile close to shore, and thus close to people and possibly an audience may cause injury. Therefore, it may be a safety feature to ensure ejection only at suitable speeds. It may be possible to vary the speed limit.

According to an embodiment, the control system may further comprise a mode selector comprising at least one preset mode. There may be a MANUAL mode. The manual mode may comprise manual elements such as manual ON/OFF switch. It is also possible that ejection is done manually. There may be one or more preset modes. The preset mode may comprise track data, such as: number of markings of the track, longitudinal distance between markings in relation to the extension of a mid-line of the track, transverse distance between a first marking and the mid-line or the second marking, perpendicularly to said mid line of the track. There may be more track data included in the mode, such as combinations thereof.

According to one embodiment, the mode selector comprises a manual mode and at least a first predetermined mode. The predetermined mode may comprise track data, such as number of markings of the track and/or longitudinal distance between markings in relation to the extension of the mid-line of the track and/or transverse distance between markings perpendicularly to said mid line (M) of the track.

In one embodiment the control system comprises at least a second preset mode, in which said number of markings are set to CONTINOUS. In that type of mode, the marker ejector may be configured to continuously eject marker projectiles until manual cancellation is done. This type of mode may be useful in the event of training. Normally, a competition track comprises a set number of markings, depending on the type of competition and possibly the age of the contestants. A training track may however be as long as needed and may thus be manually operated such that when the mode selector is switched on to continuous, the marker ejector continuously ejects marker projectiles until switched off, or the until the marker projectiles run out.

According to another embodiment, the marker ejector may comprise a ejector tube through which the marker projectiles may be ejected. The ejector tube may be configured to eject the marker projectile in a path so that the marker projectiles collides with the water surface at a predetermined impact point. Thus, the ejector tube may be formed so that the marker projectile assumes a predictable path towards the water surface. This is an advantage since a sports track normally may be arranged according to certain rules and standards.

According to an embodiment, the ejector tube may be configured to eject the projectile with a top spin. This means that the marker projectile may form a predetermined path towards the water surface. Hereby, the risk that the projectile bounces on the water surface may be reduced, since the impact angle relative the water will be steeper than a projectile without a top spin or with a backspin. Further, the instant marking on the water surface may be increased, i.e. the splash may be more distinct, if the projectile is spun in a top spin direction. A top spin is meant to be a spin where the lower portion of the projectile rotates back towards the ejector tube and the top portion rotates towards the impact point.

According to an embodiment, the ejector tube may comprise an exit portion. The exit portion may be bent upwards relative the opposite end of the ejector tube. The upward bend may be provided in order to obtain a travelling path for the marker projectile. The path may be depending on the amount of bend. A steep bend upwards may provide a different path than if the bend would be less steep.

According to an embodiment, the exit portion may comprise a friction lining on an inner wall of the exit portion. The friction lining may be arranged to be in contact with the ejector projectile during ejection. The friction lining in cooperation with said bent exit portion may enable a topspin on the ejector projectile and thereby leading the ejector projectile in a steeper impact towards the water. Hereby, also the ejector projectile may be prevented to bounce on the water surface. Further, a steep angle may provide a distinct splash and thereby form a clear visible marking on the water. This is an advantage since the shape of the exit portion may provide a predictable marking result, which is desired since a sports track commonly must comply with rules and standards.

According to an embodiment, the ejector tube may comprise a cover movable between a closed position in which the cover prevents a projectile to exit by mistake, and an open position in which exit of a projectile is allowed. This may be another safety feature, ensuring that a marker projectile does not accidently hit surrounding persons or objects. The cover may be movable either manually or automatically.

In one embodiment, the cover may be movable in response to the wind force. The wind force arises from the speed of the boat.

In one embodiment, the cover may comprise a spring, and the cover may be movable by pushing the spring out of the exit path. The spring may be configured to be movable by the force of wind arising from the speed of the towing boat. Thus, the cover may be moved in order to allow the exit of a projectile when the boat has reached a predetermined speed and to prevent the exit of a projectile when the boat is static and moving too slow. The cover may spring back to its closed position once the boat slows down and the wind force decreases. Hence, accidental ejection of a projectile when the boat is not moving in a predetermined speed may be prevented by the cover.

According to one embodiment, the water track marker may further comprise a holder configured to be detachably arranged on a towing boat. This means that the water track marker may be arranged at optional places. Also, as a point of security, it may be possible to remove the holder and store it in a secure place along with the water track marker, in order to prevent theft or wear and tear.

In one embodiment the cover comprises a spring, and said cover is movable by pushing the spring out of the exit path, said spring being movable by the force of wind arising from the speed of the towing boat, in order to allow the exit of a projectile when the boat has reached a predetermined speed and to prevent the exit of a projectile when the boat is static and moving too slow.

According to one embodiment, the water track marker may further comprise a second marker ejector. The first marker ejector may be configured to eject marker projectiles towards a first side of the mid line of the track, and the second marker ejector may be configured to eject marker projectiles towards a second side of the mid line of the track. This may also be an advantage because having a first and a second marker ejector may allow them to be fixedly connected and steadily ejecting projectiles in one direction each. This may ensure that the ejected projectiles assume a steady path and not so sensitive to any movement of the marker ejector. Also, in this way, the boat may always be in the center of the track and thus the track may follow the mid line of the course of the boat at all times. It may be possible to create a straight sports track or a curved sports track. The markings may however be ejected in relation to the boat regardless of the boat's course.

In one embodiment, the marker ejector is configured to eject projectiles in a pattern. The pattern may be a zig-zag pattern, such as a slalom track. The sportsman may thus round one marking and then slide over to the other side and round another marking. At the same time, the marker ejector may eject new marker projectiles for the sportsman to round, and repeat this behavior until the whole track has been finished. In one embodiment, the pattern may correspond to a standard pattern for a water sports track, such as a waterski track. This may e.g. have a fixed longitudinal distance and transversal distance relative the travelling path of the boat. The pattern may also be such that the track has one or more subsequent markings on a first side, and then one or more markings on the second side. Thus, the track can be formed in any way suitable, having any number of markings on any of the first or second side. In that way, any pattern may be achieved.

In one embodiment, the marker projectiles may comprise an outer shield which is water soluble. The projectile may have an inner filling which is fluid. The marker projectile may be arranged to break upon impact with the water surface and cause a splash mark. The marker projectiles may be spherical. The marker projectiles may be of a type similar to paintball markers. The filling may be transparent. In that case, only the splash mark on the water surface may be visible. The filling may also be colored, in order to provide a color marking on the water surface. It is possible that the different available marker ejectors may be loaded with different colored projectiles. This may be an advantage if the sports track should contain markings to mark different aspects of the sports track.

According to a second aspect there is provided a method for marking an instant and temporary sports track, such as a water ski track, on a water surface using a water track marker which comprises a marker ejector, arranged on a towing boat, said method comprising the steps of ejecting a first marker projectile to a first side of said towing boat, ejecting a second marker projectile to a second side of said towing boat, so that said first and second marker projectiles marks a temporary sports track.

According to one embodiment, said track marker may comprise a control system for further carrying out the steps of determining a speed of a towing boat on which a marker ejector may be arranged. Based on said determined speed, the step of determining a time interval between the ejection of the first marked projectile and the second marker projectile.

According to another embodiment, the method further comprises the steps of repeating the method so as to eject a plurality of first and second projectiles, for forming a zig-zag sports track on a water surface. In this way, a pattern may be formed, such as a slalom track, at which a sportsman rounds each marking, one at a time.

According to another embodiment, the method further comprises the steps of enabling a mode selector which may comprise at least a first predetermined mode, comprising track data of a choice of track. The steps may comprise selecting a mode comprising the track data, ejecting the first and second projectiles according to the selected mode. The modes may comprise track data such as number of projectiles, distance between projectiles etc.

According to a third aspect there is provide a towing boat comprising a water track marker. The water track marker may be as previously discussed, and therefore also have corresponding advantages. Further, the boat may be equipped with an integrated water track marker, e.g. integrated in the boat hull or superstructure.

BRIEF DESCRIPTION OF THE DRAWINGS

The invention will in the following be described in more detail with reference to the enclosed drawings, wherein.

DETAILED DESCRIPTION OF EMBODIMENTS

Figure 1:
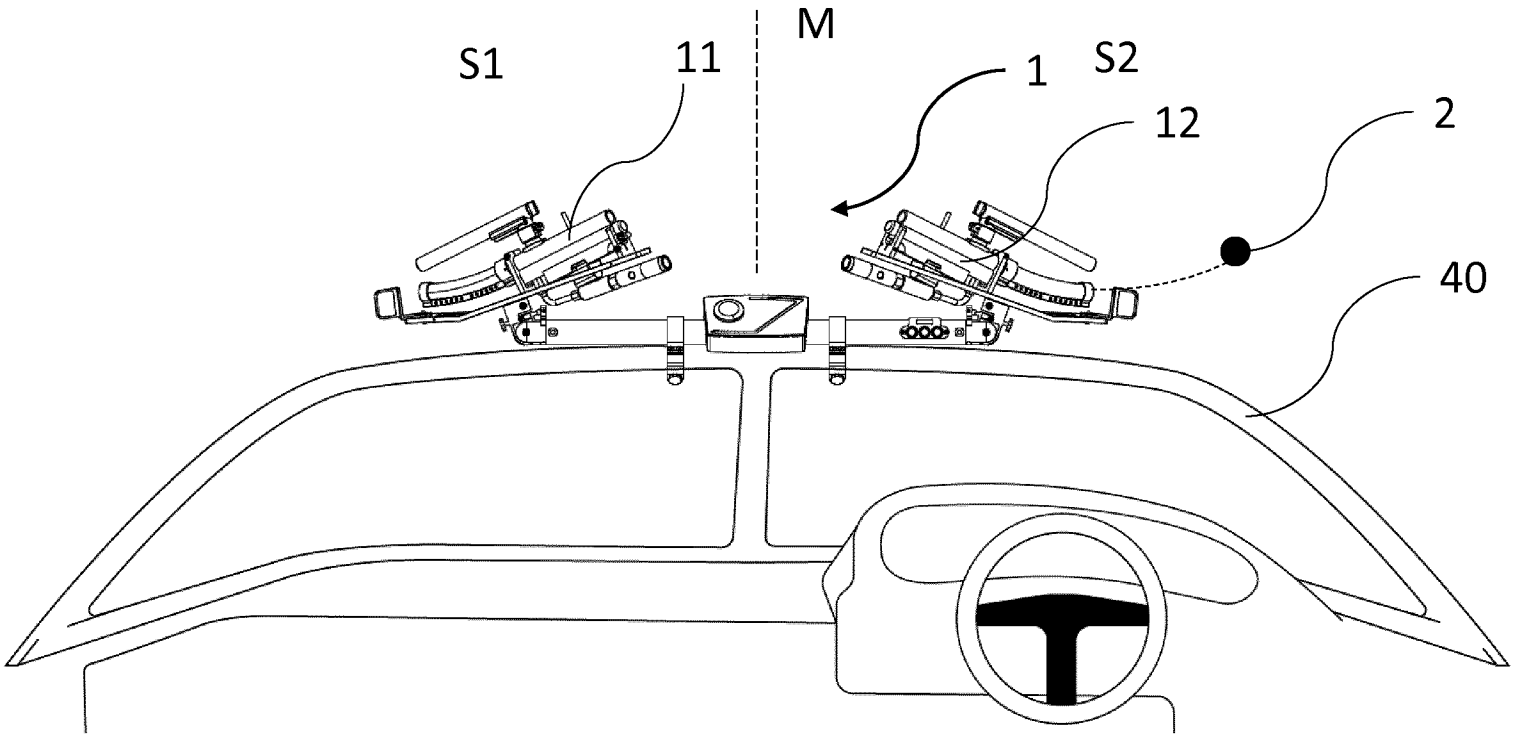
FIG. 1 is a rear view of a water track marker according to an embodiment of the invention, seen in the direction of movement of a towing boat.

The present invention will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, like numbers refer to like elements. In FIG. 1, a rear view of a water track marker 1 is shown. The water track marker 1 is seen in the direction of forward movement of a towing boat 40. The towing boat 40 is arranged to tow a person, such as a person performing water sport such as water skiing. The water track marker 1 is located on the front of the boat 40 and this particular arrangement comprises two marker ejectors 11, 12, the first marker ejector 11 pointing in a left direction, slightly forward and the second marker ejector 12 pointing in a right direction, slightly forward. The right marker ejector 12 ejects marker projectiles 2 along a predetermined path. The path may be determined by several factors; the direction of the marker ejector 12, and the velocity of which the marker projectile 2 exits the marker ejector. The speed of the boat 40 will also be a contributing factor.

Figure 2:
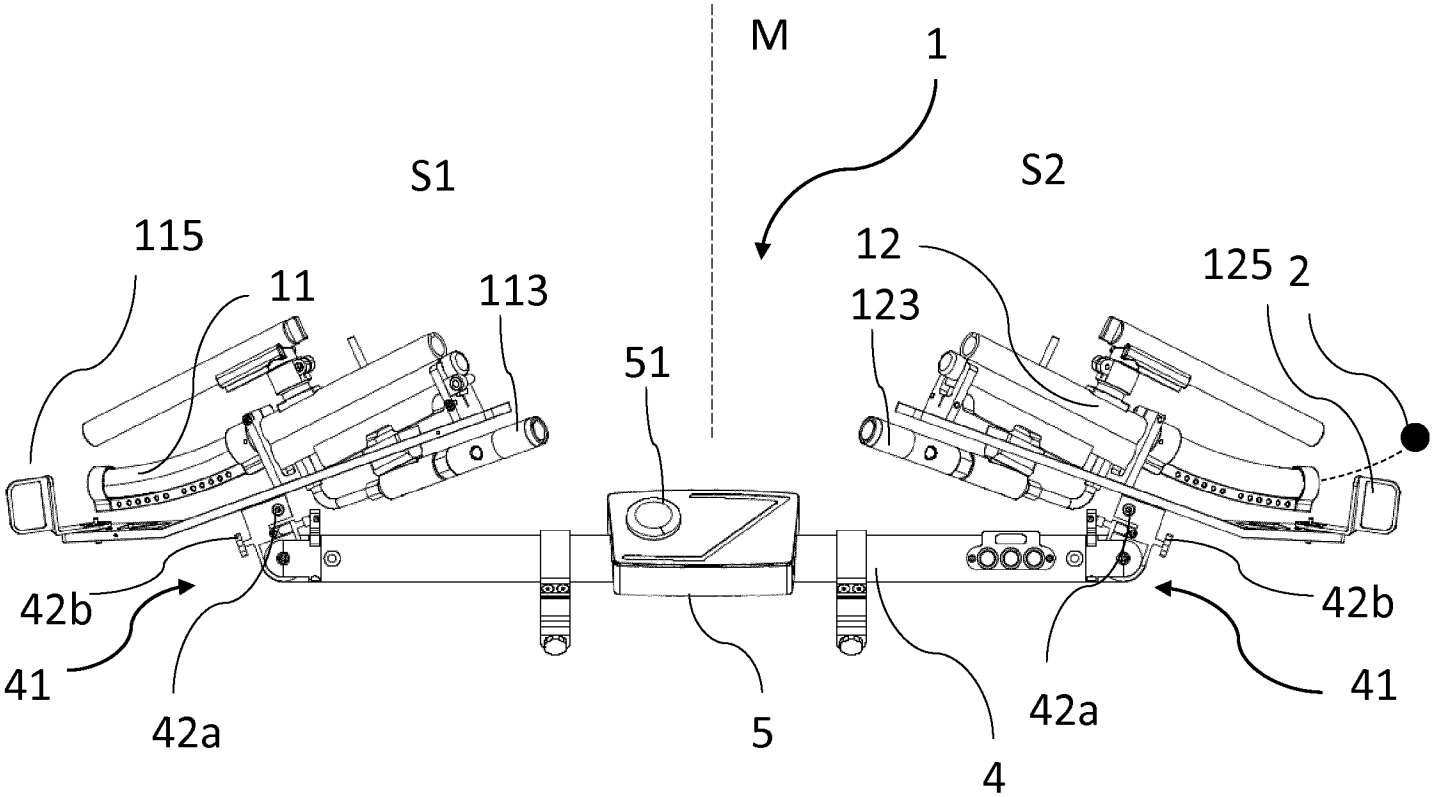
FIG. 2 is a rear view of a water track marker according to an embodiment of the invention.

In FIG. 2, the water track marker 1 is seen in more detail. The view is also seen from the rear. As seen, the marker ejectors 11, 12 point slightly forward towards the sides S1, S2. The first marker ejector 11 is pointing towards a first side S1, which is towards the water on its corresponding side of the boat (not shown). Equally, the second marker ejector 12 is pointing towards a second side S2, which is towards the water on its corresponding side of the boat 40. The marker ejectors are arranged on a holder 4, which in turn is detachably arranged on the towing boat (not shown). The marker ejectors 11, 12 are arranged to the holder 4 by attachment arrangement 41. The attachment arrangement 41 may be pivotally adjustable on the holder 4 in order to allow adjustability of the marker ejectors 11, 12. This may be in order to adjust a path of the marker projectiles 2. In a common embodiment, the marker ejectors may be pointing slightly forward out towards the sides. This may be in order not to risk to hit the towed person with a marker projectile. Adjustment may be done by for example tuning screws. In that way fine calibration of the marker ejectors 11, 12 may be allowed. Adjustment may be possible in one or more directions, for instance angularly in a horizontal plane or a plane at an angle relative to the vertical plane. It may also be angularly adjustable in a vertical plane. There is also a possibility that the adjustment may be done via a three-dimensional pivot point. In this particular installation, the attachment arrangement 41 comprises a first tuning screw 42*a* for rotational adjustment in the vertical plane, and a second tuning screw 42*b* for rotational adjustment in the horizontal plane or a plane nearly horizontal. It may be a possibility that the adjustment is done automatically based on the distance to the water surface for instance. The marker ejectors are each arranged to eject marker projectiles 2. The marker projectiles may be spherical objects, like balls, which upon impact with the water surface break and cause a splash marking 3. The splash marking will provide for an instant and temporary marking for marking a sports track, such as a water ski course. The marker ejectors are configured to eject marker projectiles at a certain velocity in order to form a zig-zag pattern in the water. Depending on the speed of the boat, the marker projectiles 2 may be ejected at different time intervals, one at the time. Further, the track marker 1 comprises a control system 5, having a speed sensor 51, in this embodiment illustrated in as a GPS. The control system comprises a control unit having for example a general-purpose processor, an application specific processor, a circuit containing processing components. The control unit is communicatively connected to the marker ejectors 11, 12 and is configured to control system parameters such as timing of the ejections. The connection may be wired or wireless. Moreover, the control unit may be embodied by one or more control units, where each control unit may be either a general purpose control unit or a dedicated control unit for performing a specific function. It should be understood that the control unit may comprise a digital signal processor arranged and configured for digital communication with an off-site server or cloud based server or with another device such as a mobile device in the vicinity of the control unit. Thus data may be sent to and from the control unit. E.g. a track pattern may be created/selected in a smart phone and the communicated to the control unit, for executing said track.

Figure 3:
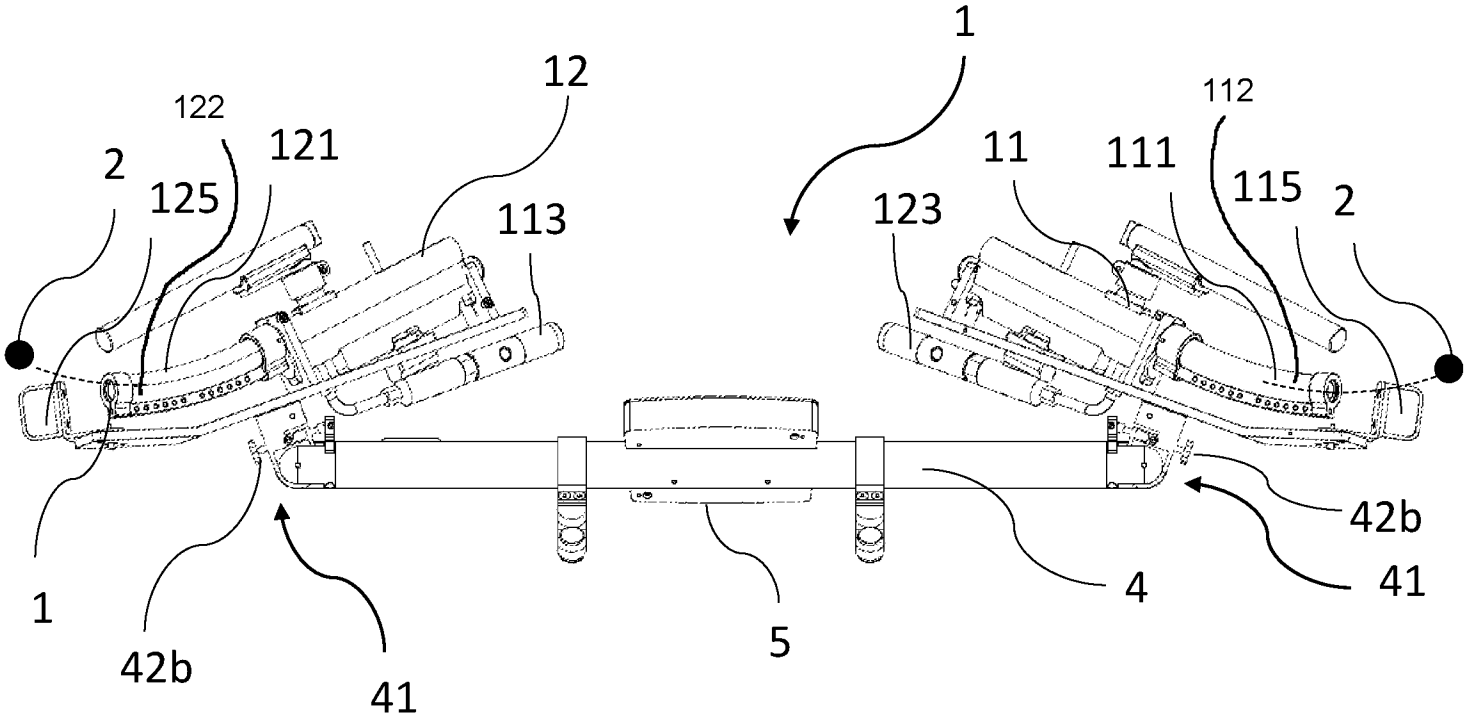
FIG. 3 is a front view of a water track marker according to an embodiment of the invention.

FIG. 3 is a front view of a water track marker 1 according to an embodiment, corresponding to the one in FIG. 2. Here it is seen more clearly, that the marker ejectors 11, 12, in this particular installation are similar. Hereinafter if not mentioned specifically, it will be assumed that the first and second marker ejectors 11, 12 may be identical, or at least comprising similar features. The marker ejectors may resemble a soft projectile gun, such as a paintball gun, having features as such in order to launch a projectile. The marker ejectors 11, 12 comprise an ejector tube 111, 121, through which a marker projectile 2 is ejected. The ejector tube 111, 121 comprises an exit portion 112, 122 through which the marker projectile 2 exits. The exit portion 112, 122 may be shaped in a suitable manner in order to lead the marker projectile through the exit portion to obtain a desired path towards the water surface 20. This shape may thus be of great importance in order to obtain a predictable result wherein the marker projectile impacts the water surface at a predetermined location. The exit portions 112, 122 have a bent shape pointing slightly upwards. The ejector tube 111, 121 may have an internal lining (not shown) of a material having high friction. This material may be a rubber like material. The upward bent shape, in combination with the high friction lining, may result in that the projectile obtains a spin, which subsequently leads the projectile in a more direct steep path towards the water surface, ensuring that the projectile does not bounce on the water surface but breaks upon impact. This provides higher accuracy as well as a larger splash on the water surface. The amount of splash may be important for the water skier, since a large splash is more visible than a small splash. Also, a larger splash may linger longer on the water surface.

Figure 4:
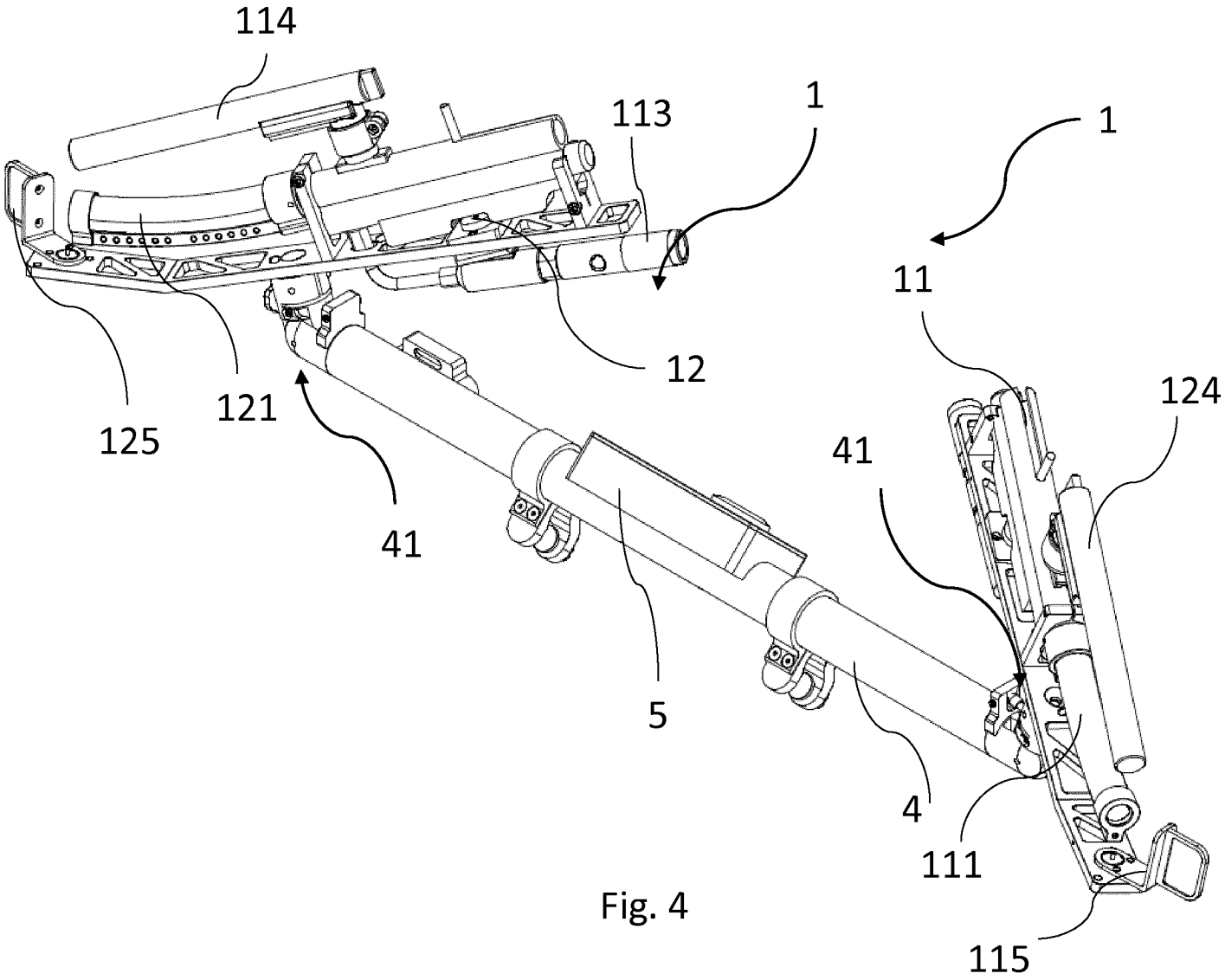
FIG. 4 is a perspective view of a water track marker according to an embodiment of the invention.

FIG. 4 is a perspective view of a water track marker 1 according to an embodiment of the invention. Each of the marker ejectors 11, 12 comprise a corresponding projectile magazine 114, 124 in which the marker projectiles 2 are loaded. The projectile magazine may hold a plurality of projectiles, at least to cover the numbers of projectiles 2 to be ejected for marking of one specific track. More specifically, the magazines may each hold at least three projectiles, more preferably at least five projectiles, or even more preferably at least ten projectiles. A larger magazine 114, 124 allows the marking of several tracks and/or a longer type of track. It is possible that there is a single large magazine holding projectiles 2 for both marker ejectors. Further, a marker ejector 11, 12 of a certain type suitable for marking a sports track on the water may comprise pressurized gas tank 113, 123 (best shown in FIGS. 2 and 3) configured to comprise expandable gas, such as compressed air or carbon dioxide. Further, the gas tank is fluidly connected to the marker ejector's ejector tube for allowing compressed gases to flow from the gas tank to the barrel through the a powertube and bolt which propel the loaded projectile forward. The projectile magazine is loaded with spherical projectiles. The projectiles may be paintball beads with colorless filling and shells. The balls burst upon impact with water and sink. The projectiles may be 100% bio-degradable.

Figure 5:
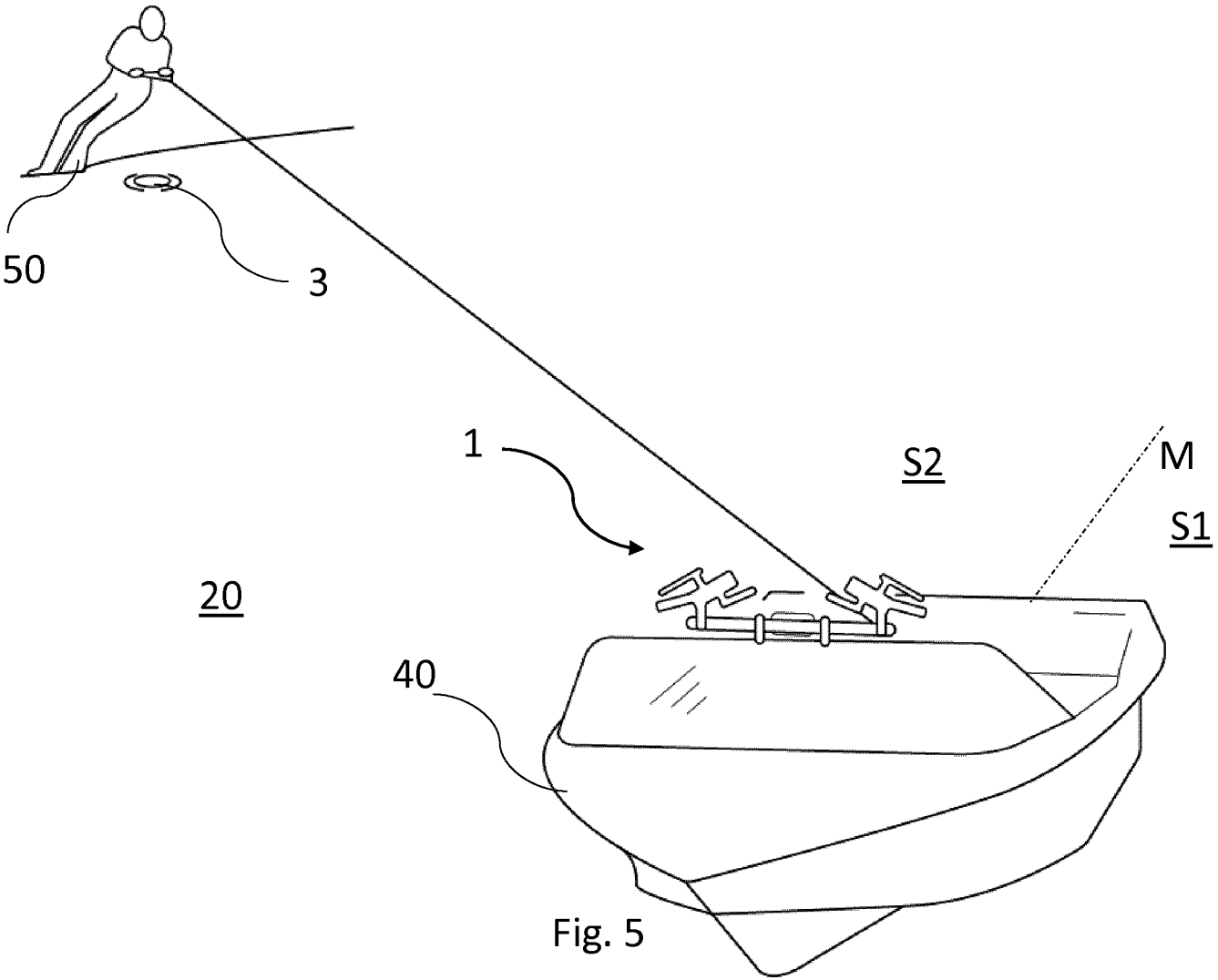
FIG. 5 is a perspective schematic view of a towing boat having a water track marker according to an embodiment of the invention and towing a water skier on a water sports track.

In FIG. 5, there is an exemplary view of a towing boat 40, towing a water skier 50 which is rounding a marking 3 on a sports track. It can be seen that the water track marker 1 is arranged to the boat 40. The water track marker may be arranged by clips, screws, or similar fastening items. Attachment arrangement may use quick clips. When the boat 40 has pulled the water skier 50, it is moved out on the left side of the boat and gives a clearing sign. The boat driver then starts at a time when a strong white LED lights up. The water skier waits until the diode goes out. In the following, it will be described how the control system 5 is used. The control system 5 with GPS receiver, or another speed sensor, determine the speed of the boat and then energizes solenoids which are used to release the pressurized gas from the gas tank and fire the marker projectiles 2. The system may be configured to be limited to function during speed between 40 km/h and 60 km/h. That is a safety feature which ensures that the marking of a track only occurs at safe speeds, and not during start and stop. It may be configured to function at different speeds as well. However, it may be suitable that these speeds are safe for a sportsperson to be towed. Regardless of the speed of the boat, the system is configured to mark the water surface at predetermined marking intervals. A common track may comprise six markings, three at 41 meter intervals. The six markings are distributed by three markings on each side S1, S2 of a mid-line M. It should however be understood that a sports track may comprise any number of markings and any distances between them.

Figure 6:
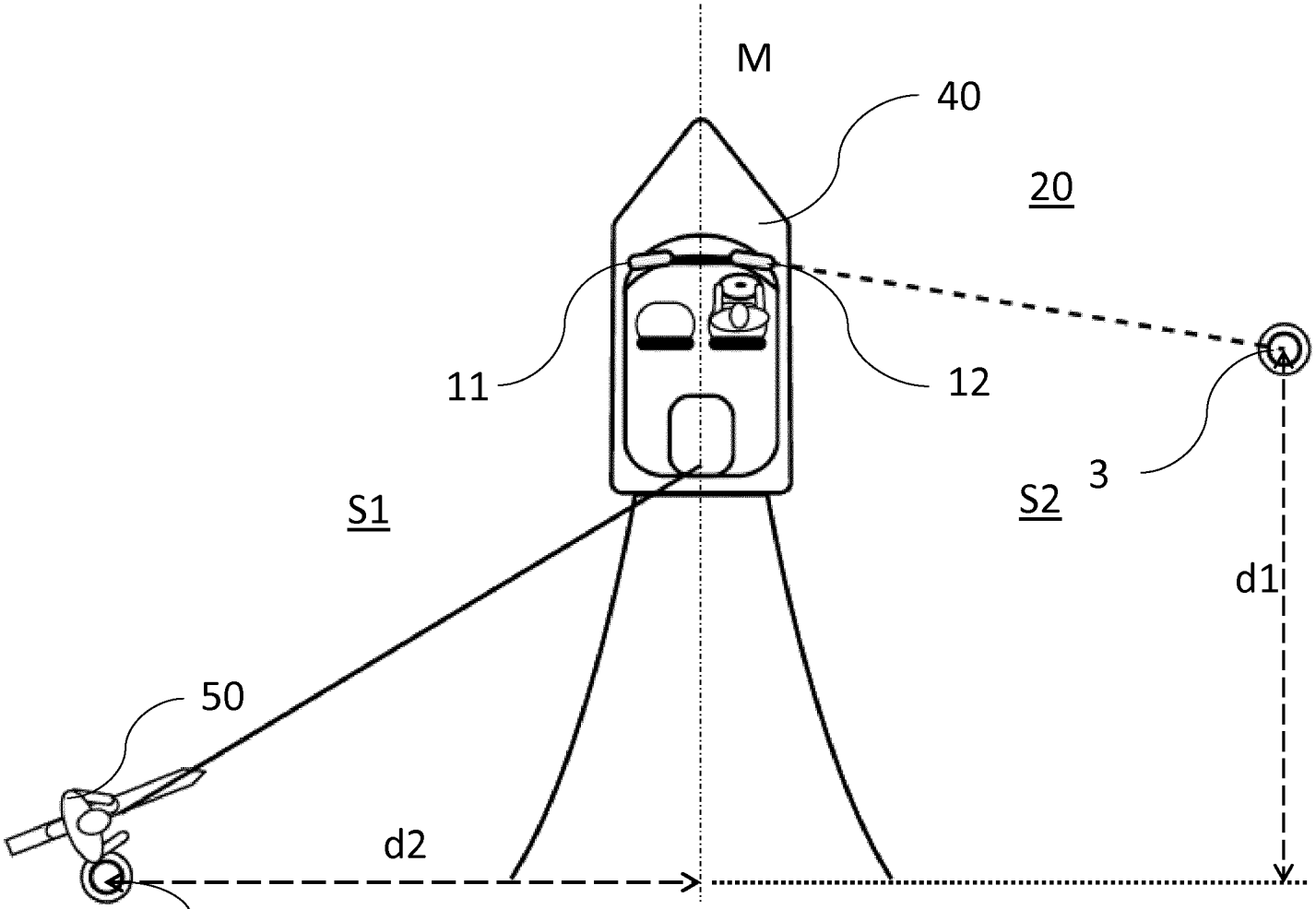
FIG. 6 is a top schematic view of a towing boat having a water track marker according to an embodiment of the invention and towing a water skier on a water sports track.

FIG. 6 is a top view of a towing boat 40 towing a water skier while the water track marker 1 simultaneously ejects marker projectiles 2.

In the drawings and specification, there have been disclosed preferred embodiments and examples of the invention and, although specific terms are employed, they are used in a generic and descriptive sense only and not for the purpose of limitation, the scope of the invention being set forth in the following claims.

The invention claimed is:

1. A water track marker for temporary marking of a sports track on a water surface comprising:

at least a first marker ejector configured to eject marker projectiles towards the water for creating an instant marking on the water surface upon impact with the water surface, and a control system for automatically controlling an ejecting timing to eject said marker projectiles according to a predetermined track data.

2. The water track marker according to claim 1, wherein said first marker ejector is configured to eject the projectiles variably to a first side and second side of a middle line of the sports track.

3. The water track marker according to claim 1, wherein said first marker ejector is configured to be arranged on a towing boat, said towing boat being configured to tow a person.

4. The water track marker according to claim 1, wherein said control system comprises a speed sensor for detecting the speed of a towing boat on which the water track marker is arranged, and said control system is adapted to control the ejection of said marker projectiles based on a detected speed of the towing boat.

5. The water track marker according to claim 4, wherein the control system is configured to only eject marker projectiles in a predetermined speed range of the towing boat.

6. The water track marker according to claim 4, wherein the control system further comprises a mode selector comprising a manual mode and at least a first predetermined mode, wherein said predetermined mode comprises track data, said track data comprising number of markings of the track, longitudinal distance between markings in relation to the extension of a mid-line of the track, transverse distance between a marking and the mid-line perpendicularly to said mid-line of the track.

7. The water track marker according to claim 6, wherein said control system comprises a second mode, in which said number of markings are set to continuous, by which the first marker ejector is configured to continuously fire marker projectiles until manual cancelation is done.

8. The water track marker according to claim 1, wherein said first marker ejector comprises an ejector tube through which the marker projectiles is ejected, wherein said ejector tube is configured to eject the marker projectile in a path so that the marker projectiles collides with the water surface at a predetermined impact point.

9. The water track marker according to claim 8, wherein said ejector tube is configured to eject the projectile with a top spin.

10. The water track marker according to claim 9, wherein said ejector tube has an exit portion, wherein the exit portion is bent upwards in order to obtain a predetermined ejector angle.

11. The water track marker according to claim 10, wherein said exit portion comprises a friction lining on an inner wall of the exit portion, said friction lining arranged to be in contact with the ejector projectile during ejection, said friction lining in cooperation with said exit portion providing topspin for the ejector projectile and leading the ejector projectile in a steep impact towards the water, preventing the ejector projectile to bounce on the water surface.

12. The water track marker according to claim 8, wherein the ejector tube comprises a cover movable between a closed position in which the cover prevents a projectile to exit by mistake, and an open position in which exit of a projectile is allowed.

13. The water track marker according to claim 1, further comprising a holder configured to be detachably arranged on a towing boat.

14. The water track marker according to claim 1, further comprising a second marker ejector, wherein said first marker ejector is configured to eject marker projectiles towards a first side of a mid-line of the track, and wherein said second marker ejector is configured to eject marker projectiles towards a second side of said mid-line of the track.

15. The water track marker according to claim 1, wherein the marker projectiles comprises an outer shield which is water soluble, an inner filling which is fluid, and wherein said marker projectile is arranged to break upon impact with the water surface and cause a splash marking.

16. A towing boat comprising a water track marker according to claim 1.

17. A method for marking an instant and temporary sports track on a water surface using a water track marker comprising a marker ejector arranged on a towing boat, said method comprising the steps:

ejecting a first marker projectile to a first side of said towing boat, and ejecting a second marker projectile to a second side of said towing boat, so that said first and second marker projectiles marks a temporary sports track.

18. The method according to claim 17, said track marker comprising a control system for further carrying out the steps:

determining a speed of a towing boat on which the marker ejector is arranged, and based on said determined speed, determining a time interval between the launch of said first marked projectile and said second marker projectile.

19. The method according to claim 17, further comprising the steps:

repeating the method so as to eject a plurality of first and second projectiles, for forming a zig-zag sports track on a water surface.

20. The method according to claim 19, said track marker comprising a control system further comprising a mode selector which comprises at least a first predetermined mode comprising track data of a choice of track, the method further comprising the steps of enabling the mode selector, selecting a mode comprising said track data, and ejecting the first and second projectiles according to a said selected mode.

21. A water track marker for marking a sports track on a water surface comprising:

at least a first marker ejector configured to eject marker projectiles towards the water for creating an instant marking on the water surface upon impact with the water surface, and a control system for controlling ejecting timing, for the first marker ejector to eject said marker projectiles;

wherein the control system comprises a mode selector comprising at least a first predetermined mode, wherein said predetermined mode comprises track data, said track data comprising a number of markings of the track, a longitudinal distance between markings in relation to the extension of a mid-line of the track, and a transverse distance between a marking and the mid-line perpendicularly to said mid-line of the track.

* * * * *